United States Patent [19]

Deckard et al.

[11] 4,392,612

[45] Jul. 12, 1983

[54] ELECTROMAGNETIC UNIT FUEL INJECTOR

[75] Inventors: John I. Deckard, Grand Rapids; Robert D. Straub, Livonia, both of Mich.

[73] Assignee: General Motors Corporation, Detroit, Mich.

[21] Appl. No.: 350,267

[22] Filed: Feb. 19, 1982

[51] Int. Cl.[3] ..... F02M 55/00; F02M 51/00

[52] U.S. Cl. ..... 239/88; 239/585

[58] Field of Search ..... 289/88, 89, 90, 91, 289/95, 124, 585

[56] References Cited

U.S. PATENT DOCUMENTS

| | | | |
|---|---|---|---|
| 2,144,861 | 1/1939 | Truxell, Jr. | 239/90 X |
| 3,006,556 | 10/1961 | Shade et al. | 239/88 |
| 3,777,977 | 12/1973 | Regneault et al. | 239/585 X |
| 3,982,693 | 9/1976 | Hulsing | 239/88 |
| 4,046,112 | 9/1977 | Deckard | 239/96 |
| 4,129,253 | 12/1978 | Bader, Jr. et al. | 239/88 |
| 4,129,254 | 12/1978 | Bader, Jr. et al. | 239/585 X |
| 4,129,255 | 12/1978 | Bader, Jr. et al. | 239/585 X |
| 4,129,256 | 12/1978 | Bader, Jr. et al. | 239/585 X |
| 4,317,541 | 3/1982 | Beardmore | 239/88 |

*Primary Examiner*—John J. Love
*Assistant Examiner*—Jon M. Rastello
*Attorney, Agent, or Firm*—Arthur N. Krein

[57] ABSTRACT

An electromagnetic unit fuel injector for use in a diesel engine includes a housing with a pump therein defined by an externally actuated plunger reciprocable in a bushing and defining therewith a pump chamber open at one end for the discharge of fuel to a spring biased, pressure actuated fuel injection nozzle. The pump chamber is also connected to a first chamber via a solenoid actuated, normally open, hollow, ported valve controlled passage to permit the ingress and egress of fuel. The first chamber adjacent to one end of the valve is in flow communication with a second chamber at the opposite end of the valve and these chambers are connected to a drain passage and supply passage, respectively. During a pump stroke, the solenoid can be energized to move the valve in position to block flow from the pump chamber to the first chamber so as to allow the pressurization of fuel by the pump to effect discharge of fuel from the injection nozzle.

2 Claims, 4 Drawing Figures

ELECTROMAGNETIC UNIT FUEL INJECTOR

This invention relates to unit fuel injectors of the type used to inject fuel into the cylinders of a diesel engine and, in particular, to an electromagnetic unit fuel injector having a solenoid controlled, pressure balanced valve therein.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine driven cam whereby to pressurize fuel to a suitable high pressure so as to effect the unseating of a pressure actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow so as to permit the plunger to then intensify the pressure of fuel to effect unseating of the injection valve of the associated fuel injection nozzle. An exemplary embodiment of such an electromagnetic unit fuel injector is disclosed, for example, in U.S. Pat. No. 4,129,253 entitled Electromagnetic Unit Fuel Injector issued Dec. 12, 1978 to Ernest Bader, Jr., John I. Deckard and Dan B. Kuiper.

SUMMARY OF THE INVENTION

The present invention provides an electromagnetic unit fuel injector that includes a pump assembly having a plunger reciprocable in a bushing and operated, for example, by an engine driven cam, with flow from the pump during a pump stroke of the plunger being directed to a fuel injection nozzle assembly of the unit that contains a spring biased, pressure actuated injection valve therein for controlling flow out through the spray tip outlets of the injection nozzles. Fuel flow from the pump can also flow through a passage means, containing a normally open pressure balanced control valve means to a fuel drain passage means. Fuel injection is regulated by the controlled energization of the solenoid actuated pressure balanced valve means whereby it is operative to block flow from the pump to the fuel drain passage means during a pump stroke of the plunger whereby the plunger is then permitted to intensify the pressure of fuel to a value to effect unseating of the injection valve. The pressure balanced valve means is operative to reduce the force required to be applied by the solenoid in the valve means to effect sealing against the high pressure in the passage means during a fuel injection cycle.

It is therefore a primary object of this invention to provide an improved electromagnetic unit fuel injector that contains a solenoid actuated pressure balanced valve means controlling injection whereby the solenoid need only operate against a fraction of the fluid pressure generated by the plunger for controlling the start and end of injection.

Another object of the invention is to provide an improved electromagnetic unit fuel injector having a solenoid actuated, pressure balanced valve means incorporated therein that is operable upon the controlled energization of the solenoid to control the drain flow of fuel during a pump stroke and which is thus operative to control the beginning and end of fuel injection.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
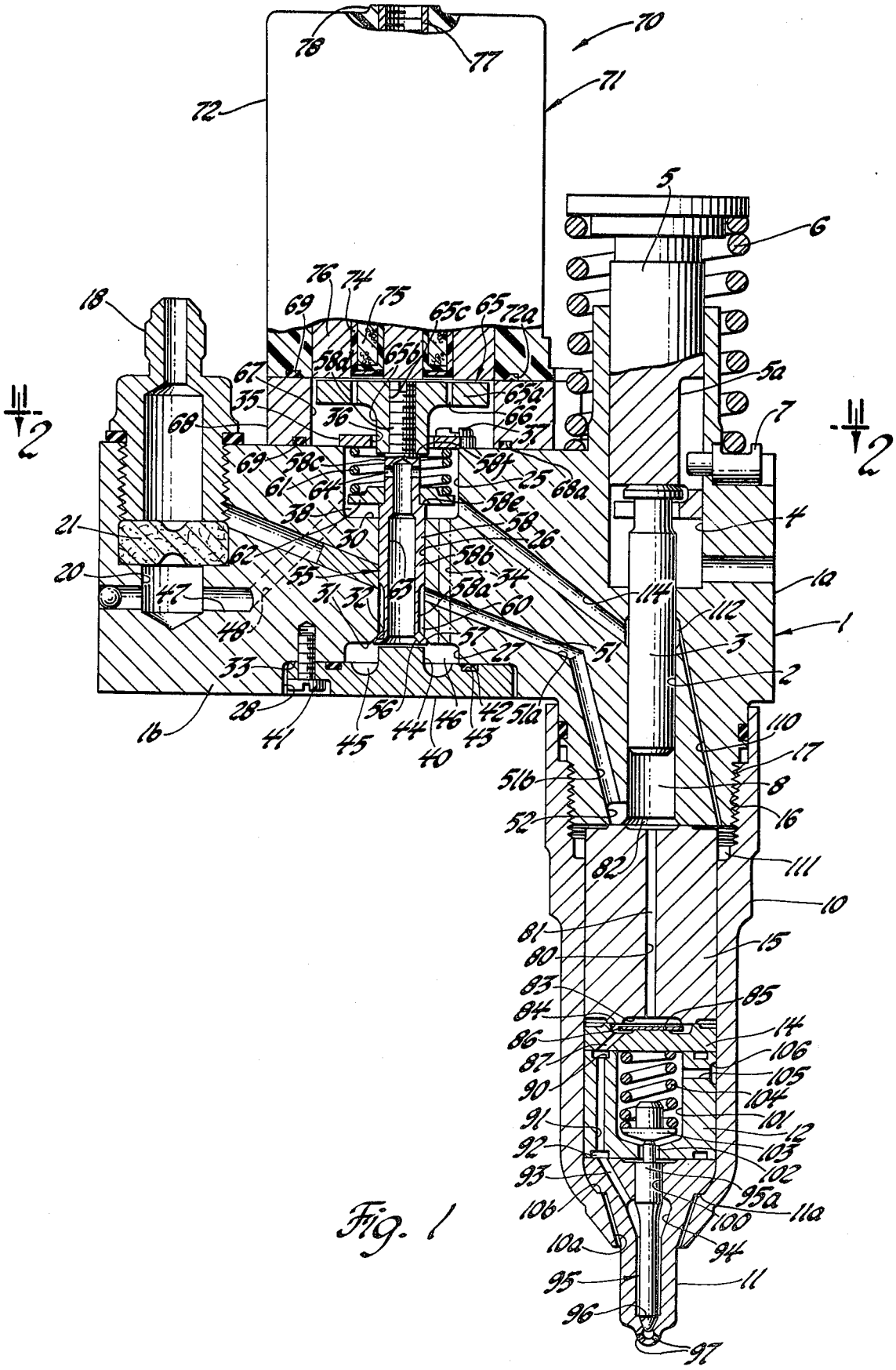
FIG. 1 is a longitudinal sectional view of an electromagnetic unit fuel injector in accordance with the invention, this view being taken along line 1–1 of FIG. 2, with elements of the injector being shown so that the plunger of the pump thereof is positioned as during a pump stroke and with the electromagnetic valve means thereof energized, and with parts of the unit shown in elevation.
Figure 2:
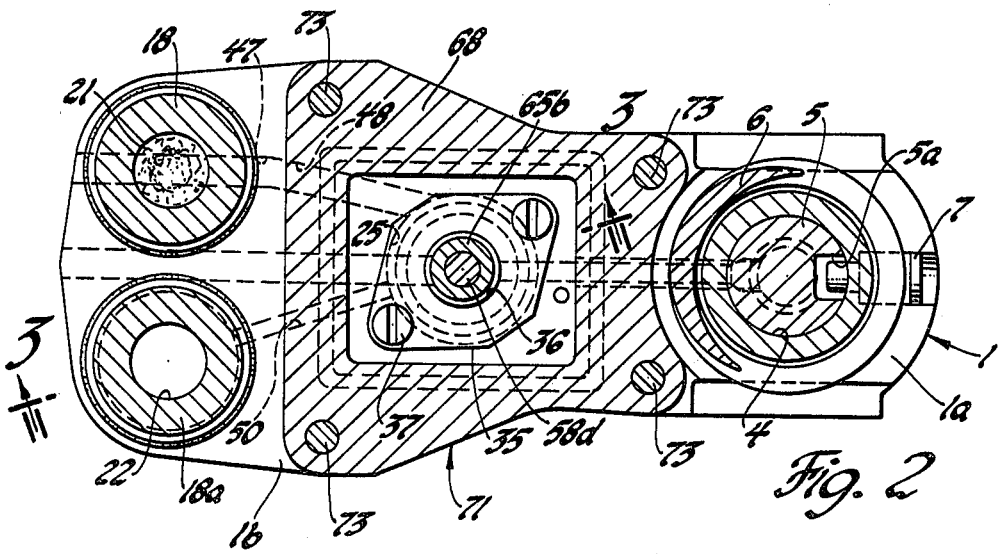
FIG. 2 is a sectional view of the electromagnetic unit fuel injector of FIG. 1 taken as along line 2—2 of FIG. 1.
Figure 3:
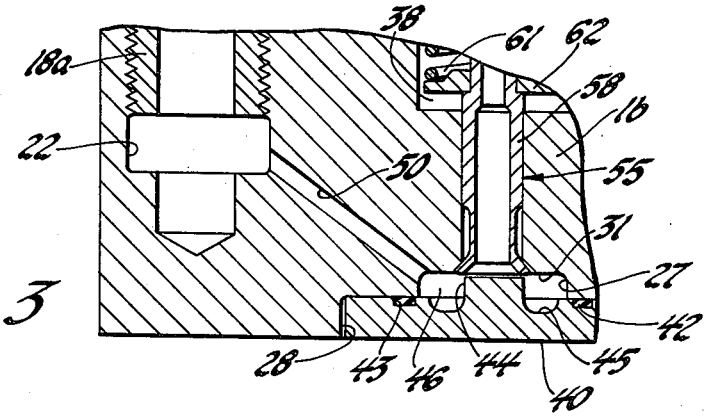
FIG. 3 is a cross-sectional view of a portion of the fuel injector of FIG. 1 taken along line 3—3 of FIG. 2.

Referring now to the drawings and, in particular, to FIGS. 1, 2 and 3, there is shown an electromagnetic until fuel injector constructed in accordance with the invention, that is, in effect, a unit fuel injector-pump assembly with an electromagnetic actuated, pressure balanced valve incorporated therein to control fuel discharge from the injector portion of this assembly in a manner to be described.

In the construction illustrated, the electromagnetic unit fuel injector includes an injector body 1 which includes a vertical main body portion **1*a* and a side body portion 1*b*. The body portion 1*a* is provided with a stepped bore therethrough defining a cylindrical lower wall or bushing 2 of an internal diameter to slidably receive a pump plunger 3 and an upper wall 4 of a larger internal diameter to slidably receive a plunger actuator follower 5. The follower 5 extends out one end of the body 1 whereby it and the plunger connected thereto are adapted to be reciprocated by an engine driven cam or rocker, in the manner shown schematically in FIG. 4, and by a plunger return spring 6 in a conventional manner. A stop pin 7 extends through an upper portion of body 1 into an axial groove 5*a* in the follower 5** to limit upward travel of the follower.

The pump plunger 3 forms with the bushing 2 a pump chamber 8 at the lower open end of the bushing 2, as shown in FIG. 1.

Forming an extension of and threaded to the lower end of the body 1 is a nut 10. Nut 10 has an opening **10*a* at its lower end through which extends the lower end of a combined injector valve body or spray tip 11, hereinafter referred to as the spray tip, of a conventional fuel injection nozzle assembly. As shown, the spray tip 11 is enlarged at its upper end to provide a shoulder 11***a* which seats on an internal shoulder 10*b* provided by the through counterbore in nut 10. Between the spray tip 11 and the lower end of the injector body 1 there is positioned, in sequence starting from the spray tip, a rate spring cage 12, a spring retainer 14 and a director cage 15, these elements being formed, in the construction illustrated, as separate elements for ease of manufacturing and assembly. Nut 10 is provided with internal threads 16 for mating engagement with the external threads 17 at the lower end of body 1. The threaded connection of the nut 10 to body 1 holds the spray tip 11, rate spring cage 12, spring retainer 14 and director cage 15 clamped and stacked end-to-end between the upper face 11*b* of the spray tip and the bottom face of body 1. All of these above-described elements have lapped mating surfaces whereby they are held in pressure sealed relation to each other.

Fuel, as from a fuel tank via a supply pump and conduit, not shown, is supplied at a predetermined relatively low supply pressure to the lower open end of the bushing 2 by a fuel supply passage means which, in the construction shown, includes a conventional apertured inlet or supply fitting 18 which is threaded into an internally threaded, vertical, blind bore, inlet passage 20 provided adjacent to the outboard end of the side body portion 1*a* of the injector body 1. As best seen in FIG. 1, a conventional fuel filter 21 is suitably positioned in the inlet passage 20 and retained by means of the supply fitting 18. As best seen in FIGS. 2 and 3, a second internally threaded, vertical blind bore in the side body portion 1*a* spaced from the inlet passage 20 defines a drain passage 22 with a fitting 18*a* threaded therein, for the return of fuel as to the fuel tank, not shown.

In addition and for a purpose to be described in detail hereinafter, the side body portion 1*a* is provided with a stepped vertical bore therethrough which defines a circular, internal upper wall 25, an intermediate or valve stem guide wall 26, a lower intermediate wall 27 and a lower wall 28. Walls 25 and 27 are both of larger internal diameters than the internal diameter of wall 26 and wall 28 is of a larger internal diameter than the internal diameter of wall 27. Walls 25 and 26 are interconnected by a flat shoulder 30. Wall 27 is connected to wall 26 by a flat shoulder 31 and by an annular conical valve seat 32, the latter encircling wall 26. Walls 27 and 28 are interconnected by a flat shoulder 33. A second through bore, parallel to but spaced from the valve stem guide wall 26 and extending from shoulder 30 through shoulder 31 defines a pressure equalizing passage 34 for a purpose to be described in detail hereinafter.

As shown in FIG. 1, a spring retainer 35, with a central aperture 36 therethrough is suitably secured as by screws 37 to the upper surface of the side body portion 1*a* with the axis of its aperture 36 aligned with that of the bore defining the valve stem guide wall 26. The lower face of this spring retainer defines a supply/-cavity 38 with the upper bore wall 25 and shoulder 30.

As shown in FIGS. 1 and 3, a closure cap 40, of a suitable diameter so as to be loosely received in the lower wall 28 of the side body portion 1*b* is suitably secured, as by screws 41, with its upper surface in abutment against the flat shoulder 33. An O-ring seal 42 positioned in an annular groove 43 provided for this purpose in the closure cap 40 effects a seal between this closure cap and the flat shoulder 33. As illustrated, the closure cap 40 is provided with a central upstanding boss 44, of predetermined height, and preferably, with an annular groove 45 surrounding the boss, as best seen in FIGS. 1 and 3, for a purpose to be described hereinafter. The upper face of the closure cap 40 defines with the wall 27 and shoulder 31 a spill cavity 46.

As best seen in FIGS. 1 and 2, the inlet passage 20 communicates via a horizontal inlet conduit 47 and a connecting upwardly inclined inlet conduit 48 that breaks through the wall 25 with the supply/cavity 38 and, as best seen in FIG. 3, the drain passage 22 communicates via a downwardly inclined drain conduit 50 with the spill cavity 46, this conduit opening through wall 27 and a portion of shoulder 31 into the spill cavity.

A passage 51 for the ingress and egress of fuel to the pump chamber 8 includes a downwardly inclined first portion 51*a* which, as shown in FIG. 1, opens at one end through the valve stem guide wall 26 a predetermined distance above the valve seat 32 and at its other end is connected to one end of a second downwardly inclined portion 51*b*. The opposite end of the second portion 51*b* of passage 51 opens into an arcuate chamber 52 opening into the pump chamber 8 at the lower end of the injector body.

Fuel flow between the spill cavity 46 and passage 50 is controlled by means of a solenoid actuated, pressure balanced valve 55, in the form of a hollow poppet valve. The valve 55 includes a head 56 with a conical valve seat surface 57 thereon, and a stem 58 extending upward therefrom. The stem including a first stem portion 58*a* of reduced diameter next adjacent to the head 56 and of an axial extent so as to form with the guide wall 26 and annulus cavity 60 that is always in fuel communication with the passage 51 during opening and closing movement of the poppet valve, a guide stem portion 58*b* of a diameter to be slidably guided in the valve stem guide wall 26, an upper reduced diameter portion 58*c* and a still further reduced diameter, externally threaded free end portion 58*d* that extends axially up through the aperture 36 in spring retainer 35. Portions 58*b* and 58*c* are interconnected by a flat shoulder 58*e*. Portions 58*c* and 58*d* are interconnected by a flat shoulder 58*f*. The valve 55, is normally biased in a valve opening direction, downward with reference to FIG. 1, by means of a coil spring 61 loosely encircling the portion 58*c* of the valve stem 58. As shown, one end of the spring abuts against a washer-like spring retainer 62 encircling stem portion 58*c* so as to abut against shoulder 58*e*. The other end of spring 61 abuts against the lower face of the spring retainer 35.

In addition, the head 56 and stem 58 of the valve 55 is provided with a stepped blind bore so as to materially reduce the weight of this valve and so as to define a pressure relief passage 63 of a suitable axial extent whereby at its upper end it can be placed in fluid communication via radial ports 64 with the supply/valve spring cavity 38.

Movement of the valve 55 in valve closing direction, upward with reference to FIG. 1, is effected by means of a solenoid assembly 70 which includes an armature 65 having a stem 65*b* depending centrally from its head 65*a* which in the construction illustrated is of rectangular configuration. Armature 65 is suitably secured to valve 55, as by having the internally threaded bore 65*c* therethrough threadedly engaged with the threaded stem portion 58*d* of the valve 55. The armature 65 is also provided with a plurality of passages 66 which extend through the head 65*a* thereof for the passage of fuel during movement of the armature toward the opposed working face of an associated pole piece 78. As best seen in FIG. 1, the armature is loosely received in the complimentary shaped armature cavity 67 provided in a solenoid spacer 68.

As shown, the solenoid assembly 70 further includes a stator assembly, generally designated 71, having a flanged inverted cup-shaped solenoid case 72, made for example, of a suitable plastic such as glass filled nylon, which is secured as by screws 73, FIG. 2, to the upper surface of the side body portion 1*b*, with the solenoid spacer 68 sandwiched therebetween, in position to encircle the spring retainer 35 and bore wall 25. A coil bobbin 74, supporting a wound solenoid coil 75 and, a segmented multi-piece pole piece 76 are supported within the solenoid case 72. In the construction illustrated, the lower surface of the pole piece 76 is aligned with the lower surface of the solenoid case 72, as shown in FIG. 1. With this arrangement, the thickness of the solenoid spacer 68 is preselected relative to the height of the armature 65 above the upper surface of the side body portion 1*b* when valve 55 is in its closed position, the position shown in FIG. 1, so that a clearance exists between the upper working surface of the armature and the plane of the upper surface of the solenoid spacer whereby a minimum fixed air gap will exist between the opposed working faces of the armature and pole piece. In a particular embodiment this minimum air gap was 0.103 to 0.113 mm.

Figure 4:
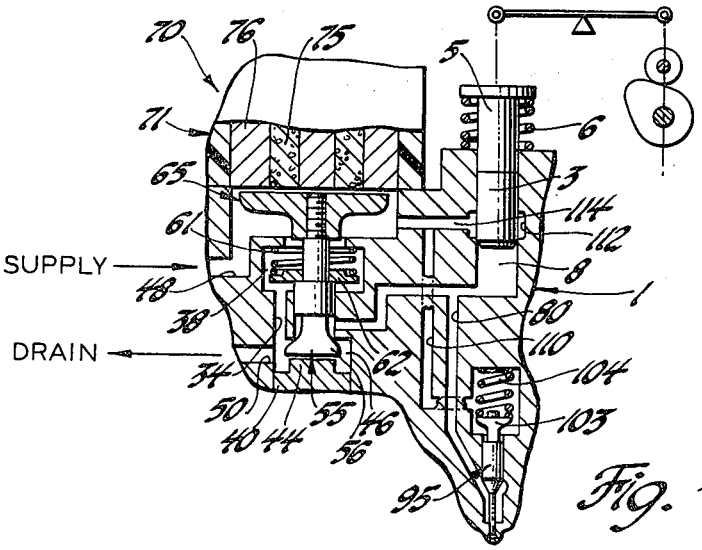
FIG. 4 is a schematic illustration of the primary operating elements of an electromagnetic unit fuel injector constructed in accordance with the invention, with the plunger shown during a pump stroke and with the electromagnetic valve means energized.

Also as best seen in FIGS. 1, 3 and 4, the head 56 of valve 55 is positioned closely adjacent to but spaced a predetermined clearance distance above the free end of boss 44 on closure cap 40, when the valve is in the closed position as shown in these Figures. This distance is selected, as desired, whereby the free end of the boss 44 is operatively positioned whereby to limit travel of the valve 55 in a valve opening direction, downward with reference to these Figures. Thus reference to the particular embodiment previously referred to hereinabove, this clearance distance was 0.103 to 0.113 mm.

The solenoid coil 75 is connectable, by electrical conductors, not shown, suitably adapted for attachment to the pair of internally threaded terminal leads 77 in the pair of apertured upstanding bosses 78, only one lead and boss being shown in FIG. 1, to a suitable source of electrical power via a fuel injection electronic control circuit, not shown, whereby the solenoid coil can be energized as a function of the operating conditions of an engine in a manner well known in the art.

As illustrated in FIG. 1, suitable O-ring seals 69 positioned in suitable annular grooves 68*a* and 72*a* provided for example in the solenoid spacer 68 and solenoid case 72, respectively, are used to effect a seal between the side body portion 1*b* and the solenoid spacer 68 and between this spacer and the solenoid case 72.

During a pump stroke of plunger 3, fuel is adapted to be discharged from pump chamber 8 into the inlet end of a discharge passage means 80 to be described next hereinafter.

An upper part of this discharge passage means 80, with reference to FIG. 1, includes a vertical passage 81 extending from an upper recess 82 through director cage 15 for flow communication with an annular recess 83 provided in the lower surface of director cage 15.

As shown in FIG. 1, the spring retainer 14 is provided with an enlarged chamber 84 formed therein so as to face the recess 83 and, projecting upwardly from the bottom of the chamber 84 is a protuberance 85 which forms a stop for a circular flat disc check valve 86. The chamber 84 extends laterally beyond the extremities of the opening defining recess 83 whereby the lower end surface of the director cage 15 will form a seat for the check valve 86 when in a position to close the opening defined by recess 83.

At least one inclined passage 87 is also provided in the spring retainer 14 to connect the chamber 84 with an annular groove 90 in the upper end of spring cage 12. This groove 90 is connected with a similar annular groove 92 on the bottom face of the spring cage 12 by a longitudinal passage 91 through the spring cage. The lower groove 92 is, in turn, connected by at least one inclined passage 93 to a central passage 94 surrounding a needle valve 95 movably positioned within the spray tip 11. At the lower end of passage 94 is an outlet for fuel delivery with an encircling tapered annular seat 96 for the needle valve 95 and, below the valve seat are connecting spray orifices 97 in the lower end of the spray tip 11.

The upper end of spray tip 11 is provided with a bore 100 for guiding opening and closing movements of the needle valve 95. The piston portion 95*a* of the needle valve slidably fits this bore 100 and has its lower end exposed to fuel pressure in passage 94 and its upper end exposed to fuel pressure in the spring chamber 101 via an opening 102, both being formed in spring cage 25. A reduced diameter upper end portion of the needle valve 95 extends through the central opening 102 in the spring cage and abuts a spring seat 103. Compressed between the spring seat 103 and spring retainer 14 is a coil spring 104 which biases the needle valve 95 to its closed position shown.

In order to prevent any tendency of fuel pressure to build up in the spring chamber 101, this chamber, as shown in FIG. 1, is vented through a radial port passage 105 to an annular groove 106 provided on the outer peripheral surface of spring cage 12. While a close fit exists between the nut 10 and the spring retainer 12, rate spring cage 14 and director cage 15, there is sufficient diametral clearance between these parts for the venting of fuel back to a relatively low pressure area, such as at the supply/valve spring cavity 38.

In the construction illustrated, this fuel is drained back to the supply/valve spring cavity 38 via an inclined passage 110 in injector body 10 which opens at its lower end into a cavity 111 defined by the internal wall of the nut and the upper end of director cage 15 and at its upper end open into an annular groove 112 encircling plunger 3 and then via an inclined passage 114 for flow communication with the supply/valve spring chamber 38.

FUNCTIONAL DESCRIPTION

Referring now in particular to FIGS. 1 and 4, during engine operation, fuel from a fuel tank, not shown, is supplied at a predetermined supply pressure by a pump, not shown, to the subject electromagnetic unit fuel injector through a supply conduit, not shown, connected to the supply fitting 18. Fuel as delivered through the supply fitting 18 flows into the inlet passage 20 and then through the inlet conduits 47 and 48 into the supply/cavity 38. From this cavity 38 fuel is then free to flow into the spill cavity 46 either by the pressure equalizing passage 34 or the pressure relief passage 63 and ports 64.

When the solenoid coil 75 of the solenoid assembly 70 is de-energized, the spring 61 will be operative to open and hold open the valve 55 relative to the valve seat 32. At the same time the armature 65, which is connected to valve 55, is also moved downward, with reference to FIGS. 1 and 4, relative to the pole piece 76 whereby to establish a predetermined working air gap between the opposed working surfaces of these elements.

With the valve 55 in its open position, fuel can flow from the spill cavity 46 into the annulus cavity 60 and then via passage 51 and arcuate chamber 52 into the pump chamber 8. Thus during a suction stroke of the plunger 3, the pump chamber will be resupplied with fuel. At the same time, fuel will be present in the discharge passage means 80 used to supply fuel to the injection nozzle assembly.

Thereafter, as the follower 5 is driven downward, as by a cam actuated rocker arm, in the manner schematically illustrated in FIG. 4, to effect downward movement of the plunger 3 this downward movement of the plunger will cause fuel to be displaced from the pump chamber 8 and will cause the pressure of the fuel in this chamber and adjacent passages connected thereto to increase. However with the solenoid coil 75 still de-energized, this pressure can only rise to a level that is a predetermined amount less than the "pop" pressure required to lift the needle valve 95 against the force of its associate return spring 104.

During this period of time, the fuel displaced from the pump chamber 8 can flow via the passage 51 and the annular cavity 60 back into the spill cavity 46 and then from this cavity the fuel can be discharged via the drain conduit 50, drain passage 22 and drain fitting 18*a* for return, for example, via a conduit, not shown, back to the fuel tank containing fuel at substantially atmospheric pressure. As is conventional in the diesel fuel injection art, a number of electromagnetic unit fuel injectors can be connected in parallel to a common drain conduit, not shown, which normally contains an orifice passage therein, not shown, used to control the rate of fuel flow through the drain conduit whereby to permit fuel pressure at a predetermined supply pressure to be maintained in each of the injectors.

Thereafter, during the continued downward stroke of the plunger 3, an electrical (current) pulse of finite characteristic and duration (time relative for example to the top dead center of the associate engine piston position with respect to the cam shaft and rocker arm linkage) applied through suitable electrical conductors to the solenoid coil 75 produces an electromagnetic field attracting the armature 65 to effect its movement toward the pole piece 76. This upward movement, with reference to FIGS. 1 and 4, of the armature 65, as coupled to the valve 55, will effect seating of the valve 55 against its associate valve seat 32, the position of these elements shown in these Figures. As this occurs, the drainage of fuel via the passage 51 and the annulus cavity 60 will no longer occur and this then permits the plunger 3 to increase the pressure of fuel to a "pop" pressure level to effect unseating of the needle valve 95. This then permits the injection of fuel out through the spray orifices 97. Normally, the injection pressure increases during further continued downward movement of the plunger.

Ending the current pulse causes the electromagnetic field to collapse, allowing the spring 61 to again open the valve 55 and to also move the armature 65 to its lowered position. Opening of the valve 55 again permits fuel flow via the passage 51 and annulus cavity 60 into the spill cavity 46. This drainage flow of fuel thus releases the system pressure in the discharge passage means 80 whereby the spring 104 can again effect closure of the needle valve 95.

Again referring to the valve 55, as illustrated this valve is constructed with a hollow center to provide four functions:

(1) mass reduction of the valve to increase its response and operational speeds;
(2) reduce valve seat stiffness to allow valve seating with a minimum force;
(3) decrease valve stiffness to reduce valve seat impact loads; and
(4) the formation of a passage 63 directly connecting the head 56 end of the valve to a low pressure cavity, that is, to the supply/cavity 38 by means of one or more ports 64 in order to maximize the valve opening response (speed).

How the fourth function, maximization of valve opening speed, is accomplished can be best understood by considering the valve operation during opening movement thereof relative to the valve seat 32. When the valve 55 first starts to open after the armature 65 is released by the electromagnetic stator assembly 71 and accelerated by the force of the valve spring 61, it will provide a flow path between the high pressure in the annulus cavity 60 and the spill cavity 46, the latter normally containing fuel at a relatively low supply pressure.

This opening movement of the valve 55 results in the rapid flow of fuel from the annulus cavity 60 into the spill cavity 46 and an increase in the pressure of fuel within the spill cavity 46 due to the limited capacity of this cavity and the finite inertia and fluid friction in the associate passages connecting the spill cavity 46 to other low supply pressure regions. However, by connecting the valve head 56 directly to a lower pressure region, that is, the supply pressure region in the supply/cavity 38, by means of the pressure relief passage 63 and radial ports 64 previously described, the hydraulic force acting on the head 56 of valve 55 due to the increased pressure in the spill cavity 46 will be minimized and the opening time of the valve 55 minimized due to the higher net amount of force available to accelerate the valve 55 in the valve opening direction. Also, as shown in FIGS. 1 and 3, the valve stem guide wall 26 and the effective working contact surface of the valve seat 32 are of the same diameter whereby to provide for equal and opposite hydraulic forces acting on valve 55. This is, the opposed working areas of valve 55 exposed to the pressure of fuel in the annulus cavity 60 are equal as shown in these Figures.

In addition by providing the pressure equalization passage 34 between the spill cavity 46 and the supply/cavity 38 at the armature end of the valve assembly, an additional increase in valve opening speed is realized due to the pressure equalization across the valve in the manner described hereinabove.

In addition to the above, by limiting the area for pressure communication between the spill cavity 46 and the valve head 56 end of valve 55 by the positioning of the boss 44, as illustrated, a further improved increase in valve opening speed is obtained.

While the invention has been described with reference to a particular embodiment disclosed herein, it is not confined to the details set forth since it is apparent that various modifications can be made by those skilled in the art without departing from the scope of the invention. This application is therefore intended to cover such modifications or changes as may come within the purposes of the invention as defined by the following claims.

The embodiments of the invention in which an exclusive property or privilege is claimed are defined as follows:

1. An electromagnetic unit fuel injector including a housing means having a fuel passage means connectable at one end to a source of fuel for the ingress or egress of fuel at a suitable supply pressure, a supply chamber and a spill chamber positioned in spaced apart relationship to each other and in flow communication with said fuel passage means, a pressure relief passage interconnecting said chambers and a valve stem guide bore extending between said chambers with a conical valve seat encircling said guide bore at the spill chamber end thereof; a pump cylinder means in said housing means; an externally actuated plunger reciprocable in said cylinder means to define therewith a pump chamber open at one end for the discharge of fuel during a pump stroke and for fuel intake during a suction stroke of said plunger; said housing means including a valve body having a spray outlet as one end thereof for the discharge of fuel; an injection valve means movable in said valve body to control flow from said spray outlet, a discharge passage means connecting said pump chamber to said spray outlet; and a solenoid actuated, poppet valve controlled passage means for effecting flow communication between said pump chamber and said fuel supply chamber and including a solenoid actuated poppet valve having a head with a stem extending therefrom journaled in said valve guide bore for reciprocable movement whereby said head is movable between an opened position and a closed position relative to said valve seat, said stem having a reduced diameter stem portion next adjacent said head which defines with said valve stem guide bore an annulus portion of said valve controlled passage means; and, a solenoid means operatively connected to said housing means, said solenoid means including an armature and a spring positioned in said supply chamber and operatively connected to said poppet valve with said spring positioned to normally bias said poppet valve to said open position.

2. An electromagnetic unit fuel injector including a housing means having a supply passage means connectable at one end to a source of fuel at a suitable supply pressure, a drain passage means for the return of fuel to a source of fuel, a supply chamber and a spill chamber positioned in spaced apart relationship to each other and in flow communication with said supply passage means and said drain passage means, respectively, a pressure relief passage interconnecting said supply chambers to said spill chamber and a valve stem guide bore extending between said chambers with a conical valve seat encircling said guide bore at the spill chamber end thereof; an externally actuated pump means in said housing means defining a pump chamber open at one end for the discharge of fuel during a pump stroke and for fuel intake during a suction stroke; said housing means including a valve body having a spray outlet at one end thereof for the discharge of fuel; an injection valve means movable in said valve body to control flow from said spray outlet, a discharge passage means connecting said pump chamber to said spray outlet; and a solenoid actuated, poppet valve controlled passage means for effecting flow communication between said pump chamber and said fuel supply chamber and including a solenoid actuated poppet valve having a head with a ported hollow stem extending therefrom, journaled in said valve guide bore for reciprocable movement whereby said head is movable between an opened position and a closed position relative to said valve seat, said stem having a reduced diameter stem portion next adjacent said head which defines with said valve stem guide bore an annulus portion of said valve controlled passage means; and, an armature and a spring positioned in said spring chamber and operatively connected to said poppet valve with said spring positioned to normally bias said poppet valve to said open position.

* * * * *